United States Patent [19]

Fellner et al.

[11] 4,236,649

[45] Dec. 2, 1980

[54] COMPACT VENDING MACHINE

[76] Inventors: Van N. Fellner, 26661 Byron Ave., Granada Hills, Calif. 91344; Frank Ruskin, 1390 Newton St., Los Angeles, Calif. 90021

[21] Appl. No.: 27,906

[22] Filed: Apr. 6, 1979

[51] Int. Cl.[3] ..... G07F 11/38

[52] U.S. Cl. ..... 221/90; 221/155; 221/281; 312/123

[58] Field of Search ..... 221/90, 89, 91, 69, 221/155, 5, 2, DIG. 1, 281; 312/117, 118, 120, 123

[56] References Cited

U.S. PATENT DOCUMENTS

| | | | |
|---|---|---|---|
| 2,108,302 | 2/1938 | Barrett | 221/90 |
| 3,125,244 | 3/1964 | Holstein | 221/281 X |
| 3,529,745 | 9/1970 | Freeman et al. | 221/90 |
| 3,777,910 | 12/1973 | Baker et al. | 221/2 X |
| 3,802,601 | 4/1974 | Ohno | 221/90 |

*Primary Examiner*—F. J. Bartuska

*Attorney, Agent, or Firm*—Henri J. A. Charmasson

[57] ABSTRACT

A vending machine which comprises a replaceable, transparent loading magazine forming an array of honeycombed slots holding the goods to be dispensed. The magazine is positioned upside down over a plate having a small trap door under each slot. A chute under the trap doors directs the food falling through the trap doors toward a dispensing slot. The trap doors are controlled by electrical signals generated upon selection of the goods by the customer. The selection is made by dialing on a numerical keyboard the identification of the slot holding the desired item. The selection is enabled by a signal issued from the coin box after acceptance of the correct change.

5 Claims, 9 Drawing Figures

FIG. 1
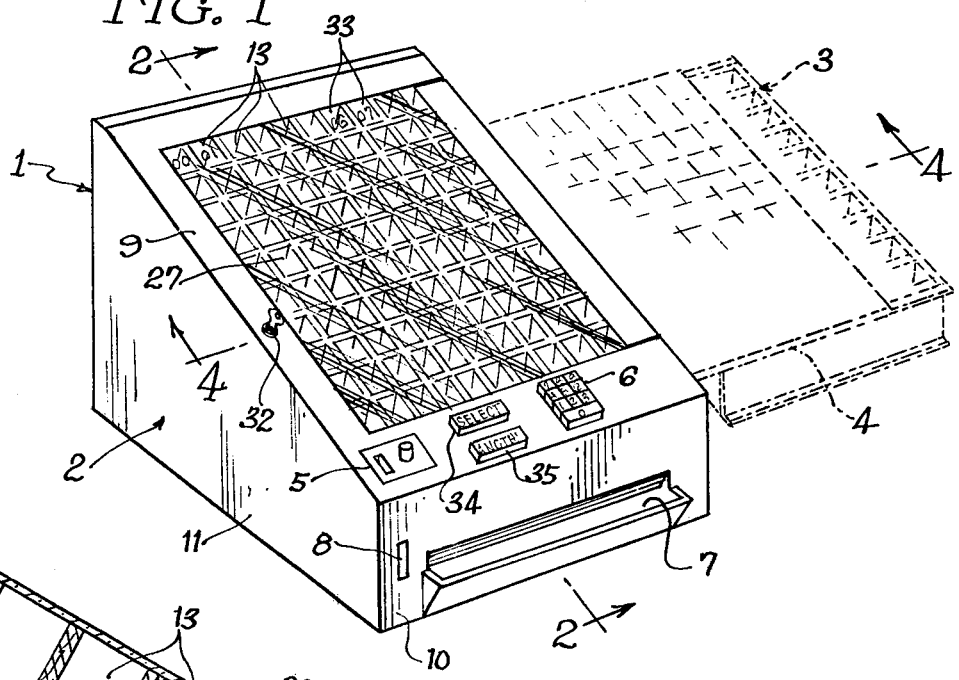
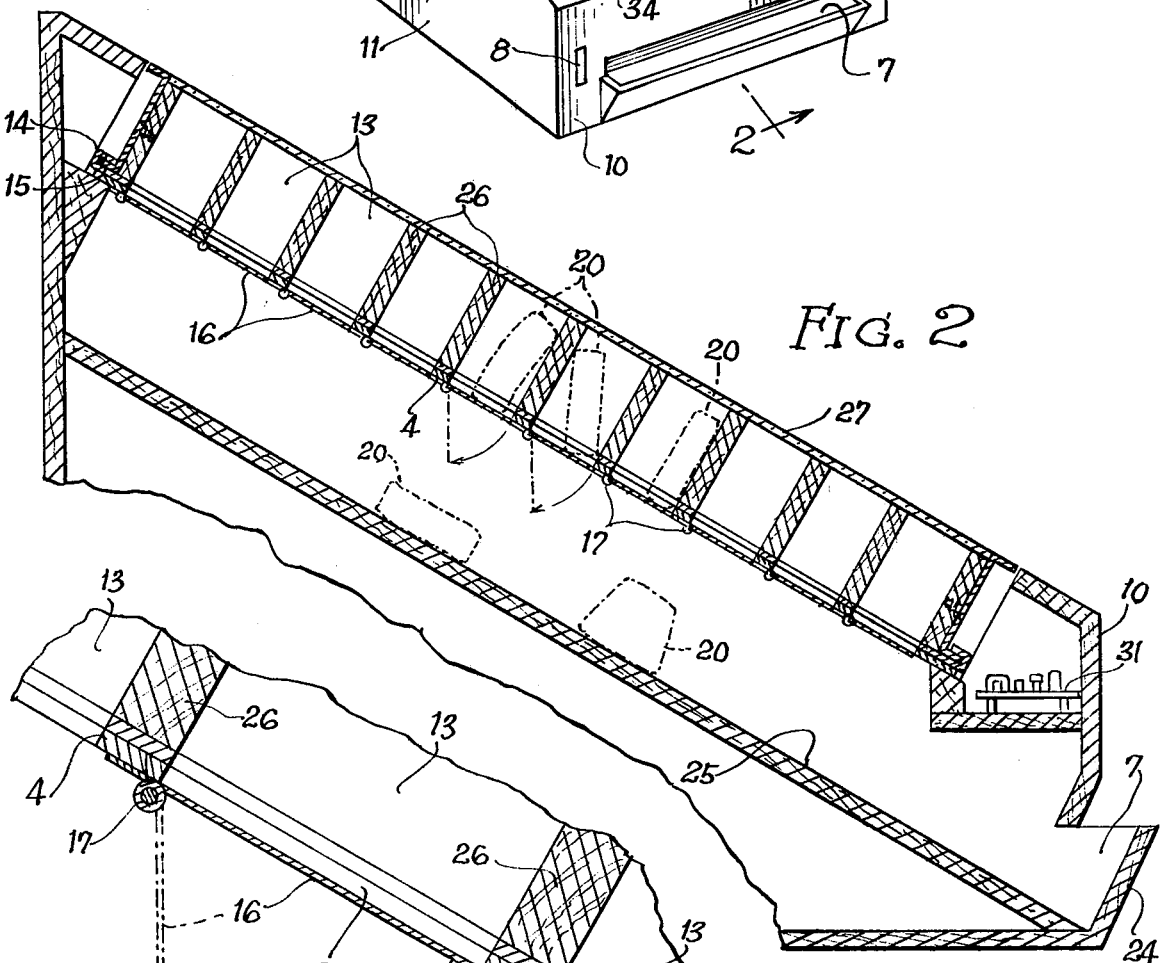
FIG. 2
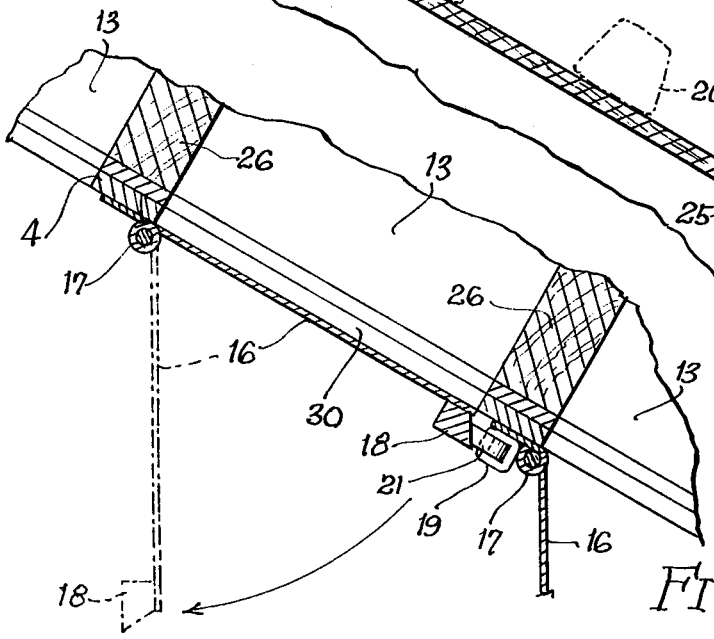
FIG. 3

COMPACT VENDING MACHINE

BACKGROUND OF THE INVENTION

This invention relates to coin-operated vending machines. Coin-vending machines which are currently in use incorporate very complex mechanical systems. Because of the complexity and cost of the mechanism used in these machines, it has not been previously economical nor practical to make small machines designed to dispense a limited number of goods. Most machines are designed to sell goods in a limited number of standard sizes such as cigarette packages or soft drink cans and bottles. These mechanical systems are very inefficient in the storage and handling of odd-sized items such as sandwiches or candy bags. Most machines, in fact, are limited to the sale of specially packaged items. Furthermore, most of those machines cannot handle more than three or four different sizes of goods. Finally, the very complexity of the mechanical structure is the cause of many mechanical breakdowns.

SUMMARY OF THE INVENTION

According to the invention, a coin-operated compact vending machine is provided which comprises a replaceable transparent loading magazine forming an array of honeycombed slots holding the goods to be dispensed. The magazine is positioned upside down on the slanted front face of the machine against a plate having a small trap door for each slot. A chute under the trap doors directs the goods toward a dispensing slot. The trap doors are electronically controlled by signals generated from a numerical keyboard. The selection is made by dialing on the keyboard the identification of the slot holding the desired item. A standard coin box enables the selection after acceptance of the correct change.

It is the principal object of this invention to provide a compact vending machine capable of holding and dispensing a great variety of goods.

It is also an object of this invention to provide a vending machine in which every item to be sold can be viewed from the outside by the customer prior to his making his selection.

A further object of the invention is to provide a vending machine particularly suitable for handling odd-sized items.

Yet another object of the invention is to provide a vending machine which does not require that the goods to be sold be packaged in a standard configuration.

A further object of the invention is to provide a machine which has a very simple mechanical structure with a minimum of moving parts.

An additional object of this invention is to provide a vending machine in which the magazine holding the sellable item can be easily removed and replaced, whereby a set of such magazines can be pre-loaded at the distribution center, stored in a servicing vehicle and quickly installed as needed on the vending machines.

These and other objects achieved by the preferred embodiment of the invention is described below.

BRIEF DESCRIPTION OF THE DRAWINGS

FIG. 1 is a perspective view of the vending machine in the operating position, with the loading position shown in phantom lines;

FIG. 2 is a cross sectional view thereof taken along lines 2—2 of FIG. 1;

FIG. 3 is an enlarged detailed view of a section of FIG. 2 showing the trap door latching mechanism;

DESCRIPTION OF THE PREFERRED EMBODIMENT OF THE INVENTION

Figure 4:
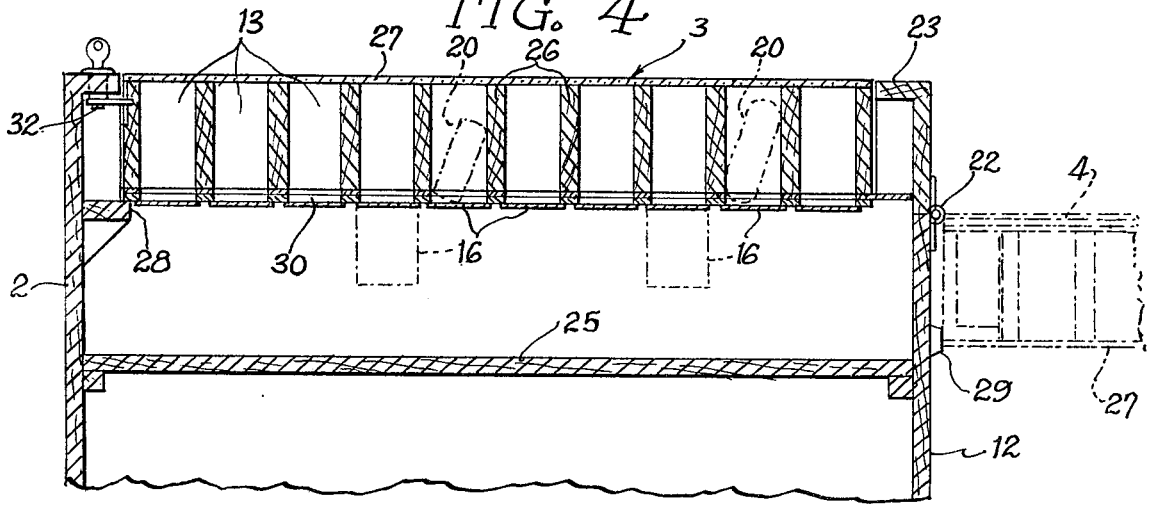
FIG. 4 is a cross sectional view of the loading machine taken along lines 4—4 of FIG. 1.

Referring now to the drawing, and according to the invention, there is shown in FIG. 1 a vending machine 1. The generally rectangular frame 2 of the vending machine 1 has a top 9 slanting downward, toward the front face 10 of the machine 1. Sunk into the slanted top 9 is a magazine 3 characterized by a transparent top 27 and a plurality of partitions 26 forming an array of rectangular slots 13. The magazine 3 is open at the bottom and rests on the base plate 4. The base plate is pivotally connected to the right side of the frame by a hinge 22. The flanged rims 14 of the magazine 3 are engaged into a set of slotted guides 15 associated with the base plate 4. Under each slot 13 of the magazine 3 is an opening 30 cut into the base plate 4. Each opening 30 is closed by a trap door 16 pivotally connected to the base board 4 by a hinge 17. A magnet 18 is bonded along the edge of each trap door 16 opposite the hinge 17. When the trap door 16 is closed the magnet 18 comes in contact with the core 21 of a solenoid 19. When the coil of the solenoid 19 in not energized, the magnetic pull of the magnet 18 upon the core 21 will keep the trap door 16 in the closed position. The latching mechanism thus created can be released, and the trap door 16 opened, by running current through the coil of the solenoid 19 in such a direction that it will create a magnetic field through the core 21 in opposition to the magnetic field of the magnet 18. It can now be understood that any item 20 placed in the slots 13 of the magazine 3 can be made to fall through the opening 30 by selectively releasing the magnetic latch of one of the trap doors 16. A slanted chute 25 is provided to funnel the items 20 dropping from the magazine slots 13 toward a distribution station 7 at the front 10 of the vending machine 1.

Figure 5:
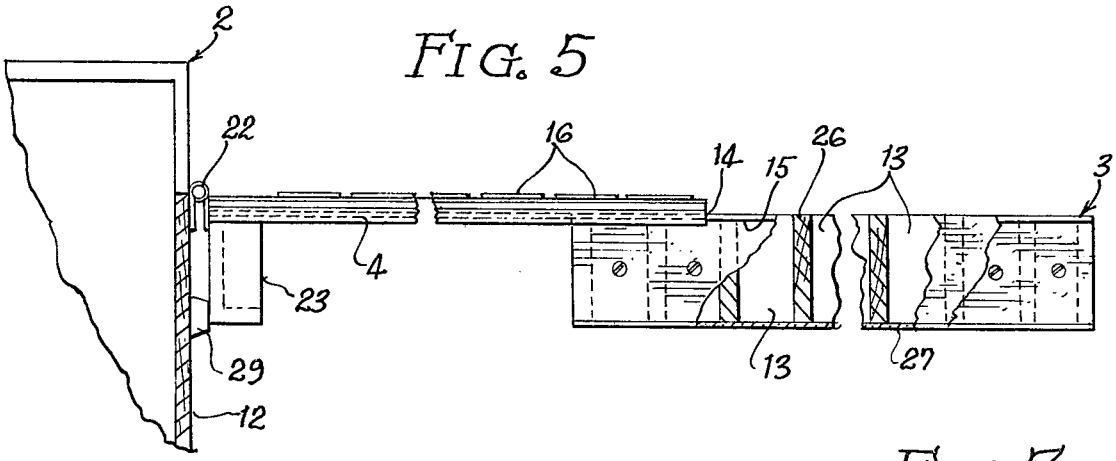
FIG. 5 is a detailed frontal view of the face plate and enclosure in the loading position.
Figure 6:
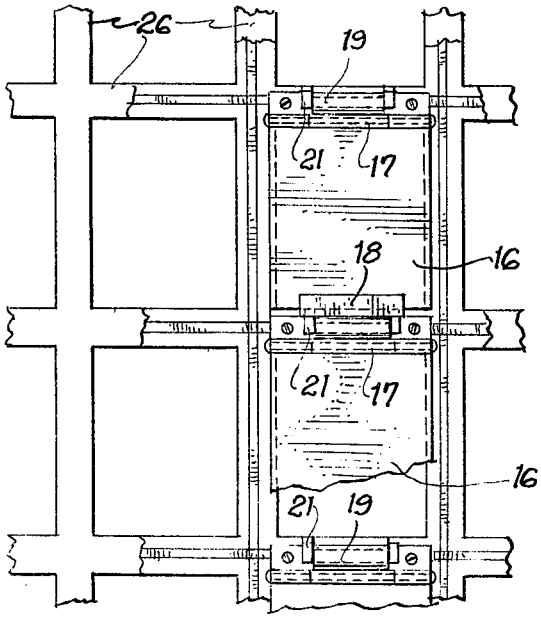
FIG. 6 is a bottom partial view of the base plate showing two adjacent trap doors.
Figure 7:
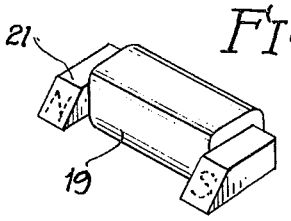
FIG. 7 is a perspective enlarged view of a trap door solenoid.
Figure 8:
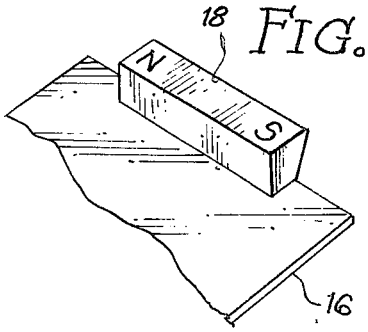
FIG. 8 is a perspective enlarged view of a magnet mounted on the edge of a trap door.
Figure 9:
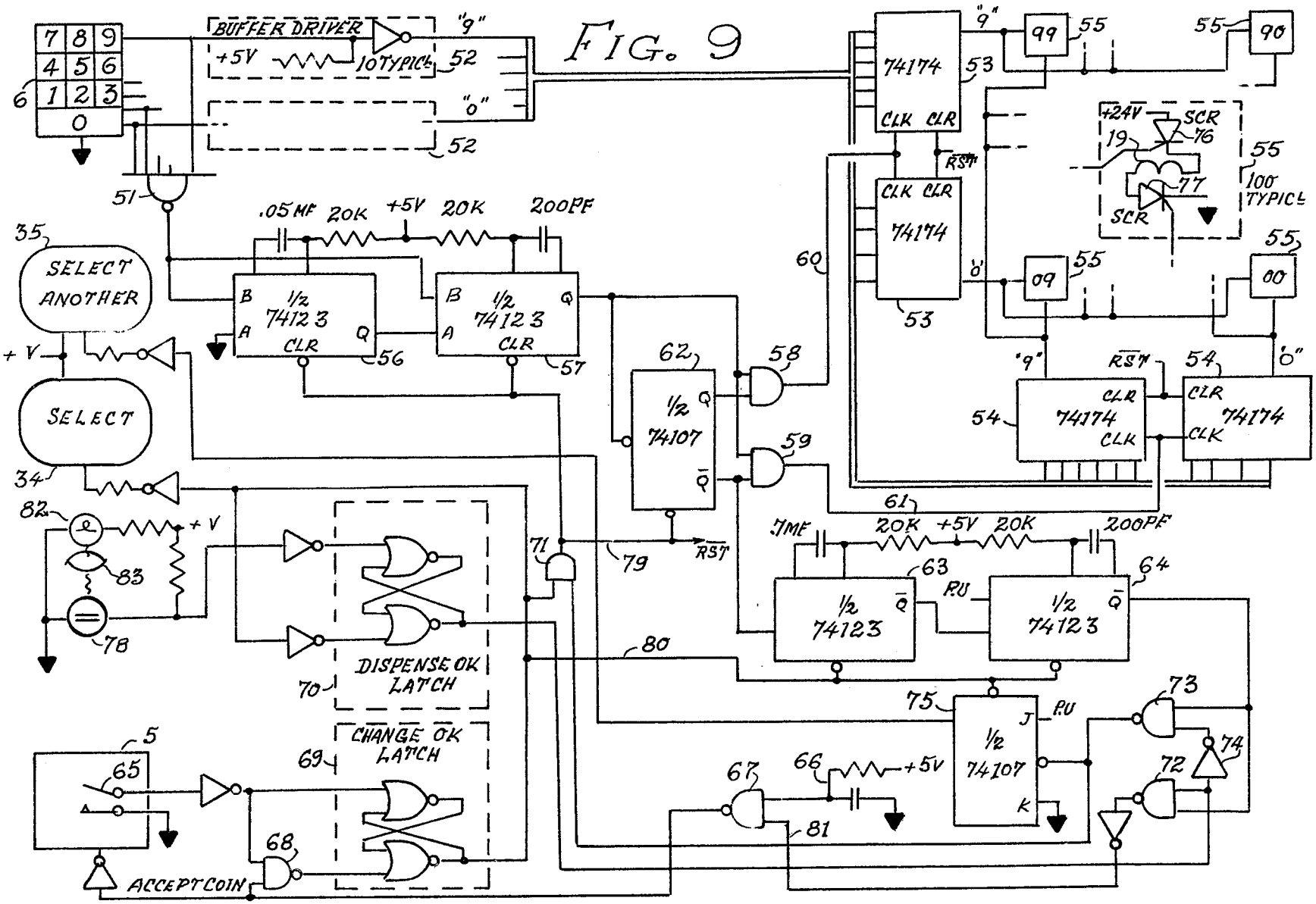
FIG. 9 is the schematic of the electrical circuit.

The vending machine 1 is remarkable in that the magazine 3 can be removed from the frame 2 by pivoting the base plate 4 around the hinge 22, and by sliding the magazine 3 out of the slotted guides 15 as illustrated in FIGS. 1 and 4 by phantom lines, and in FIG. 5. The magazine 3 may be loaded while held upside down by placing sellable items in each slot 13. The magazine 3 can then be installed back on the baseboard 4 as shown in FIG. 5. The pivotal movement of the baseboard 4 around hinge 22 when the magazine 3 is opened causes all the trap doors 16 to fall back into the closed position. When the baseboard 4 and magazine 3 are folded back into the frame 2 the trap door will remain closed until the solenoids 19 are selectively energized. A locking mechanism 32 is provided for securing the magazine 3 into the frame 2. The magazine 3 holds 100 slots arranged in a 10×10 array. Each slot 13 is identified by a numeral from 00 through 99. The selective release of a trap door under a particular slot is accomplished by operation of a coin box 5 and a keyboard 6 operating through an electrical circuit 31 to energize the corresponding solenoid 19. The coin-box 5 located in the front section of the vending machine 1 is a commercially available item not unlike the coin boxes manufactured by the Flo-onics Systems Company of Tarzana, California. The keyboard 6 has a layout similar to the keyboards found on adding machines and calculators. The keyboard 6 provides a separate contact for each of the ten keys numbered 0 through 9. The keyboard 6 is also mounted on a convenient area in the front of the vending machine 1. Next to the keyboard 6 are two lighted indicators 34 and 35. The first indicator 34 is labeled "select". The second indicator 34 is labeled "select another". The operation of the coin box 5, keyboard 6 and associated electrical circuits 31 is illustrated in the diagram of FIG. 9. The operation of the vending machine 1 begins when the operator inserts coins in the coin box 5. When the amount of change preset on the coin box controls has been recognized by the coin box mechanism, a contact closure 65 causes the setting of the "Change OK" latch 69. The output of latch 69 is fed to the input of the "Select" indicator driver. The operator must then select the item desired by dialing two keys on the keyboard 6. Those keys define the identification number of the slot holding the desired item. If, for instance, slot 45 is to be selected, the "4" key will be depressed first, and the "5" key will be actuated immediately after. Depressing a key on the keyboard 6 causes a contact closure to ground. The ten output lines of the keyboard 6 are fed first to an OR gate 51 and, second, to a set of buffer drivers 52. The outputs of the buffer drivers 52 are connected to a first set of latches 53 which are designed to hold the ten-digit, and to a second set of latches 54 which are designed to hold the unit-digit. Gate 51 generates a signal every time one of the keyboard keys is touched. This signal triggers two one-shots 56 and 57. The output of the first one-shot 56 is used to enable the input of the second one-shot 57. The first one shot 56 has a period of approximately 300 milliseconds. The second one-shot 57 has a short period of approximately 3 milliseconds. The coupling arrangement of the one-shots 56 and 57 is such that the second one-shot 57 will not fire for the second time, until the period of the first one-shot 56 has expired. When two keys are sequentially activated on the keyboard 6, one-shot 57 generates two short pulses separated by at least 300 milliseconds. These pulses are used to trigger a Flip-flop 62 whose outputs are combined with the pulses themselves through Gates 58 and 59 in order to clock the loading of the keyboard information into the storage latches 53 and 54. The outputs of the multistage latches 53 and 54 are connected to a 10× array of solenoid control circuits 55. Each solenoid controlled circuit 55 comprises a trap door latching solenoid control 19 mounted in series between two SCRs 76, 77. One of the SCRs 76 is controlled by one of the tens digit lines and other SCR 77 is controlled by one of the units digit lines. If, for instance, the ten-digit latch corresponding to numeral 4 is set and the unit-digit latch corresponding to numeral 5 is also set, the trap door solenoid 19 corresponding to the slot 13 identified by number "45" will be energized. This, in turn, will cause the trap door to open, releasing the item selected into the chute 25. Installed in the lower part of the chute 25, is a light source 82 directed by a colliminating lens 83 toward a photo sensor 78 located in the opposite side of the chute 25. Any selected item 20 sliding down the chute 25 toward the distributing station 7 causes a momentary interruption of the light beam. The resulting signal from the photo sensor is used to set a "Dispense OK" latch 70. The actuation of the second key also triggers a timing one-shot 63 with a period of approximately 4 seconds. The output of the timing one-shot 63 is used to trigger another one-shot 64 which generates a short pulse of approximately 1.2 milliseconds. This short pulse is fed to Gates 72 and 73 which are alternatively controlled by the output of the "Dispense OK" latch 70. If the "Dispense OK" latch 70 is set when the one-shot 74 is fired, Gate 72 generates an "Accept" signal 81 which is sent to the coin box 5 allowing it to accept the change. If, for instance, the slot selected was empty, or if the item was jammed and did not reach the distribution slot 7, the "Dispense OK" latch 70 would not be set at the end of the 4-second period. A Flip-flop 75 would then be set by a pulse generated through Gate 73. The output of Flip-flop 75 is used to drive the "Select Another" indicator 35. The output of Gate 73 is also used to generate a reset signal 79 through Gate 71. This reset signal 79 is used to clear the one-shots 56 and 57, the Flip-flop 62, and the latches 53 and 54. The timing one-shots 63 and 64, the "Dispense OK" latch 70, and the Flip-flop 75 are clamped down during the initial phase of the operation until the "Change OK" latch output line 80 is set to the true state. A timing circuit 66 is provided to assure the resetting of the "Change OK" latch 69 when the power is applied to the device.

While I have described the preferred embodiment of my invention, modifications can be made thereto and other embodiments may be implemented without departing from the spirit of the invention and the scope of the appended claims.

The invention claimed is:

1. A vending machine which comprises:

a generally horizontal base plate having a plurality of openings cut therethrough;

a plurality of doors for closing each of the openings independently of one another;

latching means for holding each door in a closed position across each opening;

a removable loading magazine having, in its upright position, side walls, a transparent bottom and a plurality of partitions between said walls forming an array of open slots, each slot being dimensioned and shaped to hold a sellable item which comes to rest above one of the doors as the magazine is mounted upside down above said base plate;

a chute under said openings shaped and dimensioned to funnel said item falling through any one of said openings toward a distribution station;

a box-like frame for mounting the base plate in a generally horizontal position above the chute; and means for selectively and randomly releasing said latching means for holding.

2. The structure claimed in claim 1 wherein:

said latching means for holding each door comprise magnetically latching means for holding each door in a closed position across each opening;

said means for releasing comprise:

a coin box designed to receive and verify change in a preselected amount and to issue an enabling signal;

a keyboard enabled by said signal for randomly selecting any one of said slots; and electric circuit means responsive to said keyboard section for releasing the magnetically latching means corresponding to the selected slot.

3. The structure claimed in claim 2 wherein said electrical circuit comprises:

a cross-controlled array of solenoids, each solenoid acting upon one of said magnetically latching means;

a multistage storage means for holding information generated through the keyboard; and means for cross controlling said array of solenoid in function of said information.

4. The structure claimed in claim 3 wherein said cross-controlled array comprises at each cross-point:

switching means having a first and second separate and complementary control terminals;

a coil energized by said switching means, whereby both control terminals are acted upon; and means for connecting the first control terminal to a first stage of the multistage storage means and the second control terminal to a second stage of the multistage storage means.

5. A vending machine which comprises:

a base plate having a plurality of openings cut therethrough;

trap doors pivotally connected to said plate for closing each opening independently of one another;

means for securedly holding at least one sellable item above each opening, comprising a magazine having sidewalls, a closed top, open bottom, and a plurality of vertical partitions between said walls forming an array of slots whereby each slot is positioned above one of said openings:

a chute under said openings shaped to funnel said items falling through any one of said openings toward a distribution station;

a box-like frame for mounting the base plate in a generally horizontal position above the chute wherein said base plate is pivotally connected to a lateral edge of the frame and comprises means for removably attaching the magazine to the base plate whereby the base plate and magazine can be swung around said pivotal connection to an upside down position where the magazine can be conveniently separated from the base plate; and means for selectively releasing said means for closing.

* * * * *